US006195014B1

(12) United States Patent
Sakurai et al.

(10) Patent No.: US 6,195,014 B1
(45) Date of Patent: Feb. 27, 2001

(54) FIRE DETECTOR

(75) Inventors: Kazuyoshi Sakurai; Seiji Tsubouchi, both of Tokyo (JP)

(73) Assignee: Nittan Company Limited, Tokyo (JP)

( * ) Notice: Subject to any disclaimer, the term of this patent is extended or adjusted under 35 U.S.C. 154(b) by 0 days.

(21) Appl. No.: 09/516,734

(22) Filed: Mar. 1, 2000

(30) Foreign Application Priority Data

Apr. 30, 1999 (JP) ..... 11-125383

(51) Int. Cl.[7] ..... G08B 17/10

(52) U.S. Cl. ..... 340/630; 340/628; 340/629; 250/574

(58) Field of Search ..... 340/630, 628, 340/629; 250/574, 218; 356/338

(56) References Cited

U.S. PATENT DOCUMENTS 3,708,675 * 1/1973 Tashiro et al. ..... 250/218
4,168,438 * 9/1979 Morisue ..... 250/574
4,181,439 * 1/1980 Tresch et al. ..... 356/338
4,897,634 * 1/1990 Sawa et al. ..... 340/630
5,021,677 * 6/1991 Igarashi et al. ..... 250/574
5,302,837 * 4/1994 Sawa et al. ..... 250/574
5,381,130 * 1/1995 Thuillard et al. ..... 340/630
5,477,218 * 12/1995 Manmoto et al. ..... 340/630
5,546,074 * 8/1996 Bernal et al. ..... 340/628
5,581,241 * 12/1996 Kaufman et al. ..... 340/630
5,642,099 * 6/1997 Nagashima ..... 340/630
5,670,947 * 9/1997 Nagashima ..... 340/628
5,929,988 * 7/1999 Ichikawa ..... 356/338
5,936,533 * 10/1998 Bernal et al. ..... 340/630

* cited by examiner

*Primary Examiner*—Daniel J. Wu
*Assistant Examiner*—Phung Nguyen
(74) *Attorney, Agent, or Firm*—Staas & Halsey LLP

(57) ABSTRACT

The fire detector for sensing a fire, comprises; a smoke chamber, a light emitting element, and a light detecting element for detecting a scattered light caused by scattering a light emitted by the light emitting element with a smoke which enters in the smoke chamber, wherein a wall part of the smoke chamber is formed in a shape based on a circle having a predetermined size, and comprises a projecting portion which projects from at least a part of the circle to an outside of the circle, the light emitting element is disposed on the projecting portion of the smoke chamber, and the light detecting element is arranged out of the smoke chamber and an optical axis thereof is approximately perpendicular to a plane including the circle.

14 Claims, 7 Drawing Sheets

FIRE DETECTOR

BACKGROUND OF THE INVENTION

1. Field of the Invention

The present invention relates to a fire detector for sensing a fire by detecting a smoke caused by the fire.

2. Description of Related Art

According to an earlier development, a smoke-detecting type of the fire detector which senses a fire by detecting a smoke caused by the fire by using a light emitting element and a light detecting element is often attached to one member having a disk shape so that the light emitting element is placed at a certain angle with respect to the light detecting element, for example as described in Japanese Patent Application No. Tokukai-Hei 8-166347.

However, in case that a fire detector having such a structure identified above is miniaturized, it is difficult to prepare an enough smoke detecting area because it is inevitable to shorten a distance in a radial direction, and then a distance between the light emitting element and the light detecting element becomes shorter.

Contrarily, a fire detector as described in Japanese Patent Application No. Tokukou-Sho 57-22157, has a structure where an axis of the light emitting element are approximately perpendicular to that of the light detecting element in a height direction. It is possible to miniaturize the fire detector in the radial director by sacrificing the height, that is, a thickness of the detector because of the structure thereof.

However, in case that the fire is miniaturized in the radial direction, it is necessary to prepare the smoke detecting area as large as possible.

Alternatively, the distance between the light emitting element and a wall of the smoke chamber storing the light emitting element necessarily becomes shorter by miniaturizing the detector. A reflected light generated by a reflection of a light from the light emitting element on the wall or the like is not reduced. Such a reflected light is detected by the light detecting element as a noise light, and a problem including a decrease of an S/N ratio occurs.

Further, each part of the fire detector may be located accurately in assembly process in order to stabilize the performance of the fire detector. However, regarding the assembly of the smoke chamber, when the detector is miniaturized, a space for a screw nut used frequently in a fire detector according to an earlier development, must be needed. Therefore, it is not preferred because of the restriction of the space.

SUMMARY OF THE INVENTION

The present invention was developed in view of the above problem. An object of the present invention is to provide the fire detector which can prepare the smoke detecting area enough when miniaturized, and to provide the fire detector which senses the fire at the high S/N ratio when miniaturized. Further, another object is to provide the fire detector in which the smoke chamber can be attached the smoke chamber accurately without the unneeded space when miniaturized.

In order to solve the above problem, in accordance with one aspect of the present invention, a fire detector for sensing a fire, comprises;

a smoke chamber, a light emitting element, and a light detecting element for detecting a scattered light caused by scattering a light emitted by the light emitting element with a smoke which enters in the smoke chamber, wherein a wall part of the smoke chamber is formed in a shape based on a circle having a predetermined size, and comprises a projecting portion which projects from at least a part of the circle to an outside of the circle, the light emitting element is disposed on the projecting portion of the smoke chamber, and the light detecting element is arranged out of the smoke chamber and an optical axis thereof is approximately perpendicular to a plane including the circle.

According to the present invention, because the axis of the light emitting element crosses the axis of the light detecting element along with a vertical direction, it is possible to miniaturize the fire detector in a horizontal direction. Further, because the light emitting element is arranged in the projecting portion, the distance between the axis of the light detecting element and the light emitting element can be prepared well, for example, in comparison with a case that the light emitting element and the light detecting element are arranged in the vertical direction by using the circular smoke chamber. Therefore, the large smoke detecting area can be prepared.

Accordingly, the small fire detector having the large smoke detecting area is provided.

The optical axis of the light detecting element may pass through an approximate center of the circle.

An optical axis of the light emitting element may be approximately parallel to the plane including the circle and may be approximately perpendicular to the optical axis of the light detecting element in the smoke chamber.

A circuit board for connecting with the light emitting element and the light detecting element may be disposed on a rear face of the smoke chamber, and the light detecting element may be surface-mounted on the circuit board.

According to the present invention, because the light detecting element is surface-mounted on the circuit board, an assembly process becomes simple. Besides, the storing efficiency of the circuit board is increased.

The circuit board may be disposed apart from a rear surface of the smoke chamber at a predetermined interval, a surrounding member for surrounding the light detecting element, which has a height which is approximately equivalent to the predetermined interval, is provided between the rear face of the smoke chamber and the circuit board.

According to the present invention, because the surrounding member for surrounding the light detecting element, which has a height which is approximately equivalent length to the predetermined interval, is arranged between the rear face of the smoke chamber and the circuit board, a noise light, such as a light entering into the rear face of the smoke chamber through various holes formed on the smoke chamber according to the necessity of some situations and a light emitted by the light source except the light emitting element disposed on the circuit board, is not detected by the light detecting element. Therefore, the S/N ratio is increased and a high detecting accuracy is achieved.

Hereupon, the present invention is not limited to a concrete shape of the surrounding member. However, for example, the shape thereof may be cylindrical so as to surround the light detecting element or may be a frame having a rectangular sectional shape. The surrounding member may be disposed doubly or triply.

The surrounding member may be formed on the smoke chamber in one body. A light is shielded more. Therefore, the higher S/N ratio is achieved.

A surface of the circuit board, which faces to the smoke chamber may be black. Therefore, a light reflected on the circuit board or the like is shielded as possible. The S/N ratio is increased.

A lead hole through which a lead wire led from the light emitting element is connected to the circuit board may be formed in the smoke chamber.

When the fire detector is equipped on a ceiling, the fire detector is placed so as to direct toward a surface facing to the light emitting element in the smoke chamber upwardly. However, when an inner surface of the smoke chamber, which faces to the light detecting element, is made smooth, an influence caused by a reflection of a light emitted by the light emitting element can be relatively reduced as compared to a case that a structure on which an edge portion or the like is formed is provided. Therefore, the S/N ratio is increased on this point.

In accordance with another aspect of the present invention, a fire detector for sensing a fire, comprises;

a smoke chamber, a light emitting element, a light detecting element for detecting a scattered light caused by scattering a light emitted by the light emitting element with a smoke which enters into the smoke chamber, an optical axis of the light detecting element crossing an optical axis of the light emitting element in a predetermined position, and a plurality of light shielding plates for shielding a light, which are disposed between the light emitting element and the smoke detecting area, wherein one light shielding plate selected from the plurality of light shielding plates is arranged so as to prevent the light emitted by the light emitting element from reaching an inner surface of the smoke chamber which is a monitoring area for the light detecting element, and another light shielding plate selected from the plurality of light shielding plates is arranged so as to prevent the light emitted by the light emitting element and then reflected on an end portion of the light shielding plates from reaching the light detecting element.

According to the present invention, various noise lights directed toward the light detecting element, for example, a light reflected on a wall of the inside of the fire detector and a reflected light and a diffracted light or the like generated by arranging a stop on the light emitting element side, can be prevented from reaching the light detecting element by using the two light shielding plates. Therefore, the fire detector having the high S/N ratio is achieved.

Hereupon, the present invention is not limited to the positional relationship and crossing angle between the optical axis of the light emitting element and that of the light detecting element.

At least one selected between the one light shielding plate and the another light shielding plate may comprise steps so as to be directed toward the light detecting element at an end portion thereof.

According to the present invention, even though a diffracted light or the like is generated at the end portion of the at least one selected between the one light shielding plate and the another light shielding plate, the diffracted light or the like is reflected on the step which is one step lower and which is closer to the light emitting element and can be prevented from reaching the light detecting element. Therefore, the still higher S/N ratio is achieved.

The two light shielding plates may be disposed out of a detectable area of the light detecting element.

According to the present, when the two light shielding plates are disposed out of a detectable area of the light detecting element, the smoke detecting area is not small by the two light shielding plates. A reflected light and a diffracted light from the two light shielding plates are also prevented from reaching the light detecting element.

The optical axis of the light emitting element may pass through an approximate center of the smoke chamber.

The optical axis of the light emitting element may be approximately perpendicular to that of the light detecting element.

The fire detector may comprise; another smoke chamber for incorporating the light emitting element therein, wherein the two light shielding plates are formed on the another smoke chamber in one body.

According to the invention, because the two light shielding plates are formed in one body together with the smoke chamber, the two of the light shielding plates can be arranged at a predetermined position when constructed. Therefore, a manufacturing process becomes easy.

Hereupon, the light detecting element may be disposed in the smoke chamber together with the light emitting element. The light detecting element may be disposed out of the smoke chamber so that the scattered light can be detected through a hole which is formed on the smoke chamber.

In accordance with another aspect of the present invention, a fire detector for sensing a fire, comprise;

a light emitting element, a light detecting element for detecting a scattered light caused by scattering a light emitted by the light emitting element with a smoke which enters into a smoke chamber, an optical axis of the light detecting element crossing an optical axis of the light emitting element, and a front light shielding member for shielding lights except the scattered light, which is disposed in front of the light detecting element.

According to the present invention, because the light except an objective scattered light used for sensing a fire, especially a light reflected on a corner and an end portion of a labyrinth member forming a wall of the smoke chamber, is shielded by the front light shielding member, the S/N ratio can be improved.

Hereupon, although the present invention is not limited to a shape of the light shielding member in particular, a cylindrical shape and a shape like a frame are suggested.

The optical axis of the light detecting element may pass through an approximate center of the smoke chamber.

Steps which are directed toward the light detecting element may be provided on an inner side of the front light shielding member.

According to the present invention, because a diffracted light or the like generated at an edge portion of the front light shielding member is reflected on a step which is one step lower and which is directed toward the light detecting element, and a direction of the reflected light can be changed so as to prevent the reflected light from reaching the light detecting element, the higher S/N ratio is achieved.

The light detecting element may be disposed out of the smoke chamber, a detecting hole may be formed on the smoke chamber so that the scattered light can be detected by the light detecting element, the front light shielding member may be disposed around the detecting hole in the smoke chamber, and a slant may be formed on a peripheral surface of the front light shielding member forming the smoke chamber so as to slope up to the front light shielding member.

According to the present invention, because the smoke entering into the smoke chamber is guided to the front of the light detecting element along the slant which slopes up toward the front light shielding member, the smoke is easily gathered around the detectable range of the light detecting element. Therefore, a detecting sensibility is improved.

The front light shielding member may be formed on the smoke chamber in one body. As a result, an assembly process becomes easy.

In the accordance with another aspect of the invention, a fire detector comprising a smoke chamber, for sensing a fire by detecting a smoke which enters into the smoke chamber, wherein;

the smoke chamber comprises a wall which is formed in a shape based on a circle having a predetermined size and which has a transformed portion projecting from at least a part of the circle to an outside of the circle, and a top cover and a plate for putting into the wall in upper and lower directions, the plate and the top cover which are larger than the wall, and a support member for fixing the plate and the top cover in a condition that a predetermined portions of the plate and that of the top cover are set to the transformed portions respectively is disposed out of the wall part.

According to the present invention, because the top cover and the plate are fixed to the support member by using a space which is out of the wall part, the whole smoke chamber is also fixed.

When the fire detector is assembled by setting the predetermined portion of the top cover and that of the plate to the transformed portion of the wall part, a portion in which the wall part is not occupied, is generated in the top cover and the plate.

The support member may fix a portion of the plate to that of the top cover so that the transformed portion of the plate does not correspond to that of the top cover.

According to the present invention, without preparing the space for fixing the plate and the top cover, the support member having an enough thickness can be made. The plate and the top cover are fixed strongly so that they are not released easily.

Further, when the support member is disposed on a corner, the support member itself prevents the smoke entering through a smoke hole from floating out through another smoke hole. Because the inflow of the smoke is made smooth, the high inflow property can be achieved.

A circuit board may be disposed on a rear side of the plate, a second light emitting element may be surface-mounted on the circuit board as an indication lamp and a stick-type of lens for guiding a light emitted by the second light emitting element to an outside of the fire detector may be disposed so as to face to the second light emitting element.

According to the present invention, because the second light emitting element for an indication lamp may be surface-mounted by using the stick-type of lens, a process for surface-mounting a light source for an indication lamp becomes simple. The light source or the like can be arranged on the circuit board more effectively.

The lens may penetrate at least the top cover and the plate.

According to the present invention, because the lens has the same function as the support member, the whole smoke chamber is fixed more strongly through the top cover and the plate.

Hereupon, when the smoke chamber is covered with a casing, the casing may be penetrated by the lens.

A casing for containing at least the smoke chamber may comprise an upper case and an lower case, a fixed spring for fixing the two cases to each other may be attached to one selected between the upper case and the lower case, and a spring groove for engaging with the fixed spring may be arranged on the other upper case.

According to the present invention, because the fixed spring is engaged with the spring groove, the upper case and the lower case are fixed to each other easily and fast.

The fire detector further may comprise an insect screen having a band-like metal thin plate, which prevents an insect from invading into the smoke chamber, wherein the insect screen may be formed by etching an area except both edge portions of the metal thin plate, which have a predetermined width in a longitudinal direction.

According to the present, because both edge sides of the insect screen, which have the predetermined width is not etched, a high bending strength of the insect screen is achieved. Therefore, the insect screen can be bent into deformed shapes easily and can be applied to any types of fire detectors having various shapes.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein;

FIGS. 1A to 1C are views showing an appearance of a fire detector as an example according to the present invention, wherein FIG. 1A is a plan view thereof, FIG. 1B is a front view thereof and FIG. 1C is a side view thereof;

FIGS. 2A to 2D are views for explaining an inside of the fire detector shown in FIGS. 1A to 1C, wherein FIG. 2D is a plan view showing from an upper position thereof, FIG. 2A is a sectional view along an A—A line shown in FIG. 2D, FIG. 2B a sectional view along a B—B line shown in FIG. 2D and FIG. 2C is a sectional view along a C—C line shown in FIG. 2D;

FIGS. 5A and 5B are views for explaining the insect screen according to the present invention, wherein FIG. 5A shows a part of the insect screen according to the present invention and FIG. 5B shows an insect screen according to an earlier development;

FIGS. 7A and 7B are views for explaining a first light shielding plate and a second light shielding plate of the fire detector shown in FIG. 1, wherein FIG. 7A shows a case that the light shielding plates are not provided and FIG. 7B shows a case that the light shielding plates is provided.

PREFERRED EMBODIMENT OF THE INVENTION

Hereinafter, an embodiment of the invention will be explained in view of drawings.

Figure 1A:
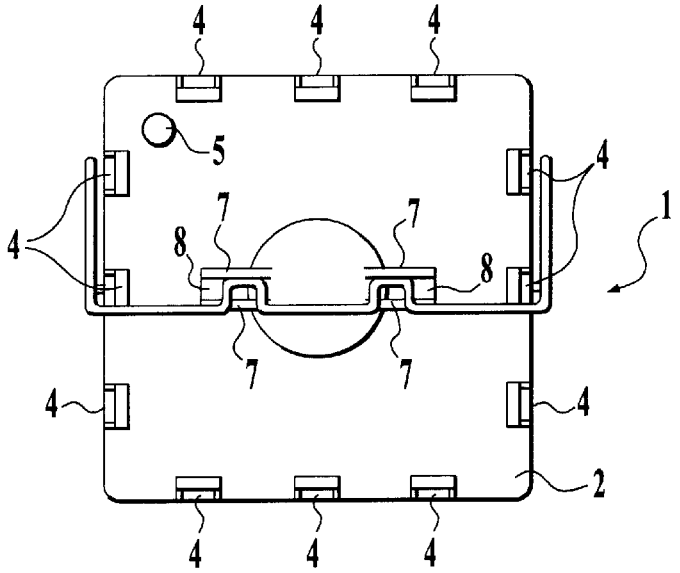
Figure 1B:
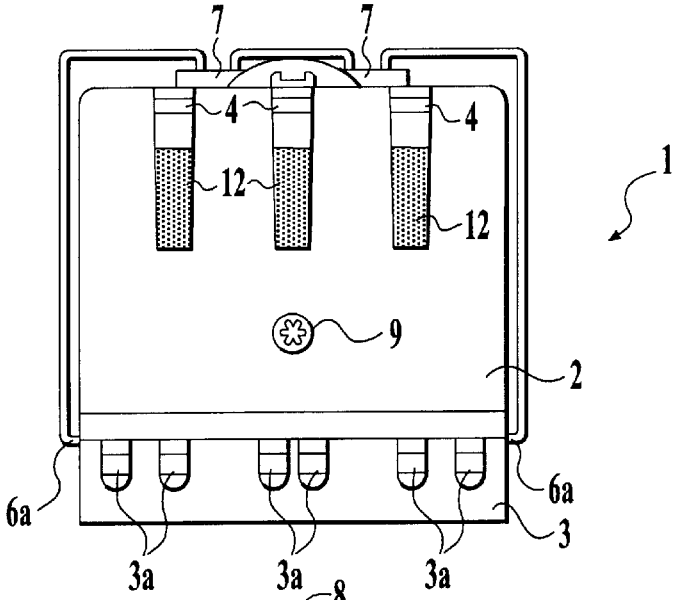
Figure 1C:
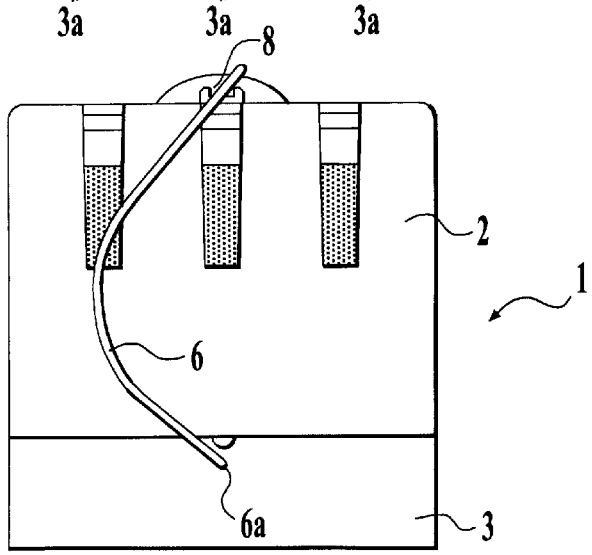

FIGS. 1A to 1C show an appearance of a fire detector 1 according to the present invention. As shown in FIGS. 1A to 1C, a casing of the fire detector 1 comprises an upper case 2 and a base 3.

When a light emitted by the light emitting element is scattered by an inflow of a smoke caused by a fire, the scattered light is detected by the light detecting element. Then, the fire detector senses a fire.

The fire detector 1 is equipped on the ceiling so that a surface shown in FIG. 1A faces to a floor. In this embodiment, the fire detector 1 will be explained by defining a side close to the floor as an upper part and a side close to the ceiling as a lower part when the fire detector is equipped.

Figures 2A, 2B, 2C, 2D:
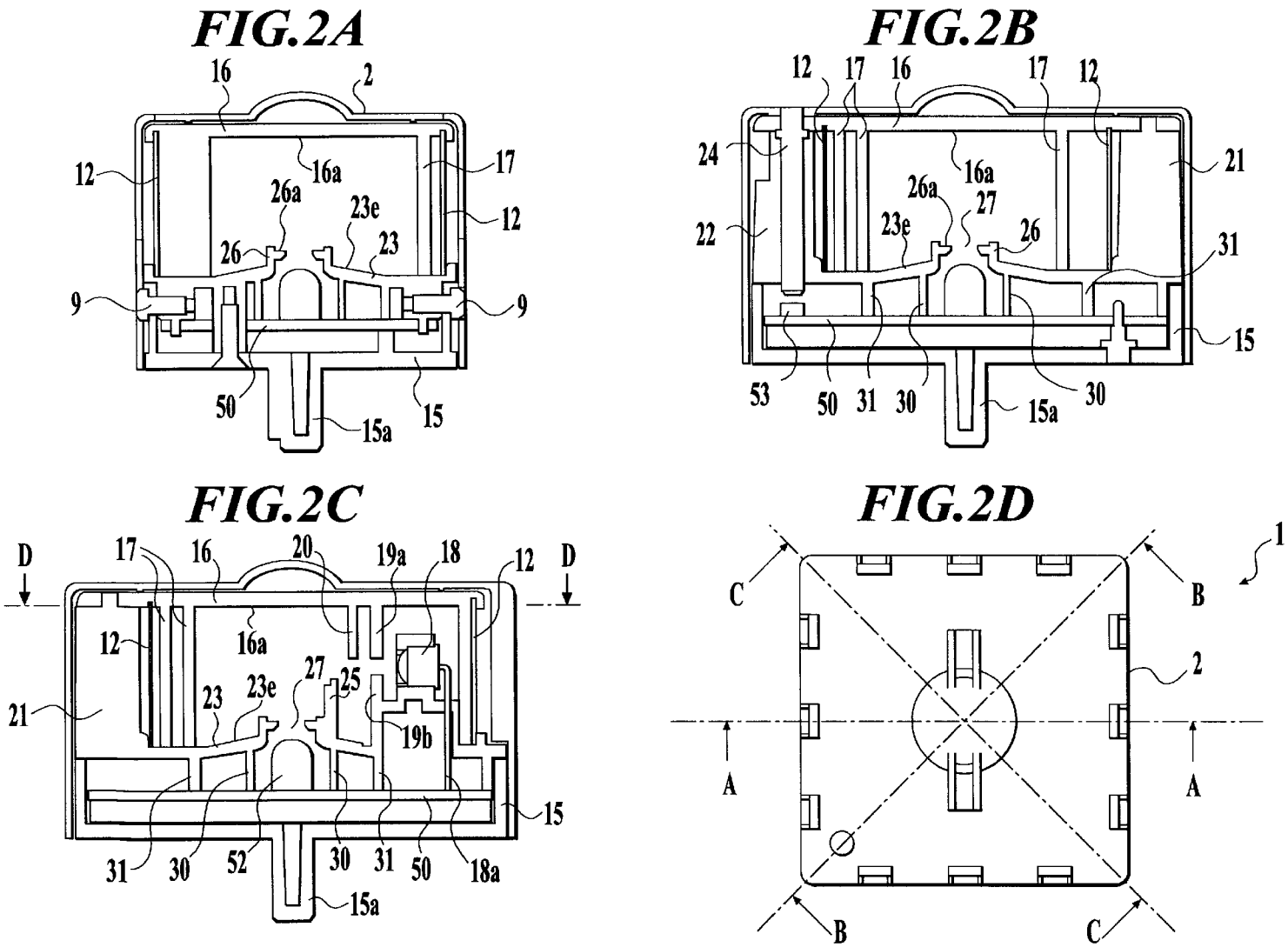

Firstly, a main body 10 which is contained into the upper case 2, is explained. FIGS. 2A to 2C show the inner side of the fire detector 1 and FIG. 2D shows a plan view of the fire detector 1 from an upper position thereof. FIGS. 2A to 2C are sectional views of the parts shown in FIG. 2D, and FIGS. 2A, 2B and 2C are the sectional views along the A—A, B—B and C—C lines shown in FIG. 2D respectively. Further, FIGS. 2A to 2C show a state without a base 3.

Figure 3:
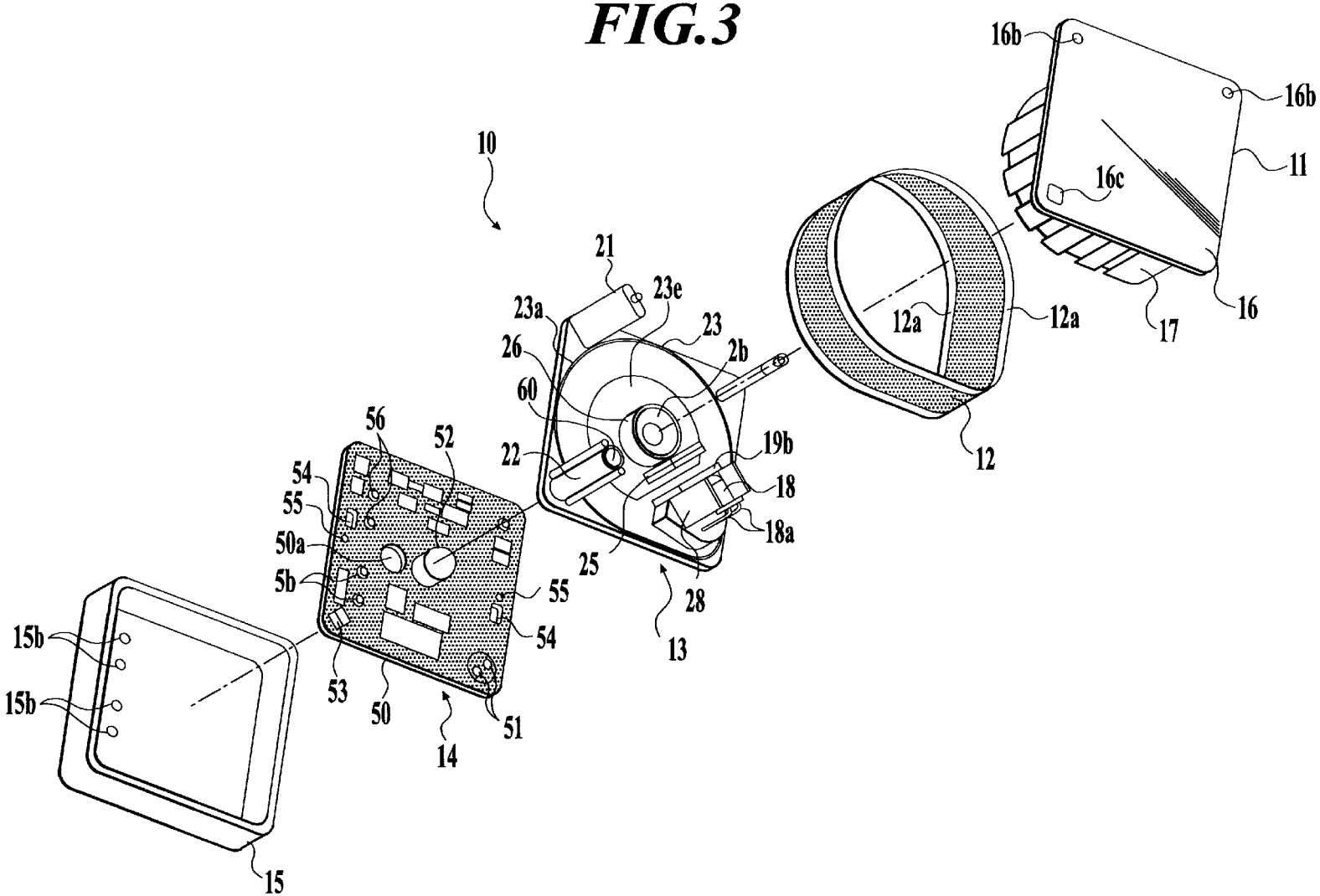
FIG. 3 is an exploded perspective view showing a schematic structure of the main body of the fire detector shown in FIG. 1.

FIG. 3 shows an exploded perspective view of the main body 10 which comprises a smoke entering part 11, an insect screen 12, a light emitting part 13, a detecting part 14 and a board receiving part 15.

The smoke entering part 11 comprises the top cover 16 and the labyrinth member 17. The smoke entering part 11 is made of a black resin. The surface thereof is made smooth. The top cover 16 is an approximately square plate and a center part 16*a* which is on a rear surface thereof is plane and smooth.

Holes 16*b* and 16*b* to which props 21 and 21 will be explained hereafter are fitted and a lens hole 16*c* through which a lens 24 penetrates, are formed at three corners of the top cover 16.

Also, a planer stop member 19*a* composing one of the stop 19 of the light emitting element 18 and a second light shielding plate 20 are provided on a rear face of the top cover 16 so as to erect them. The stop member 19*a* and second light shielding plate 20 will be explained hereafter.

Figure 4:
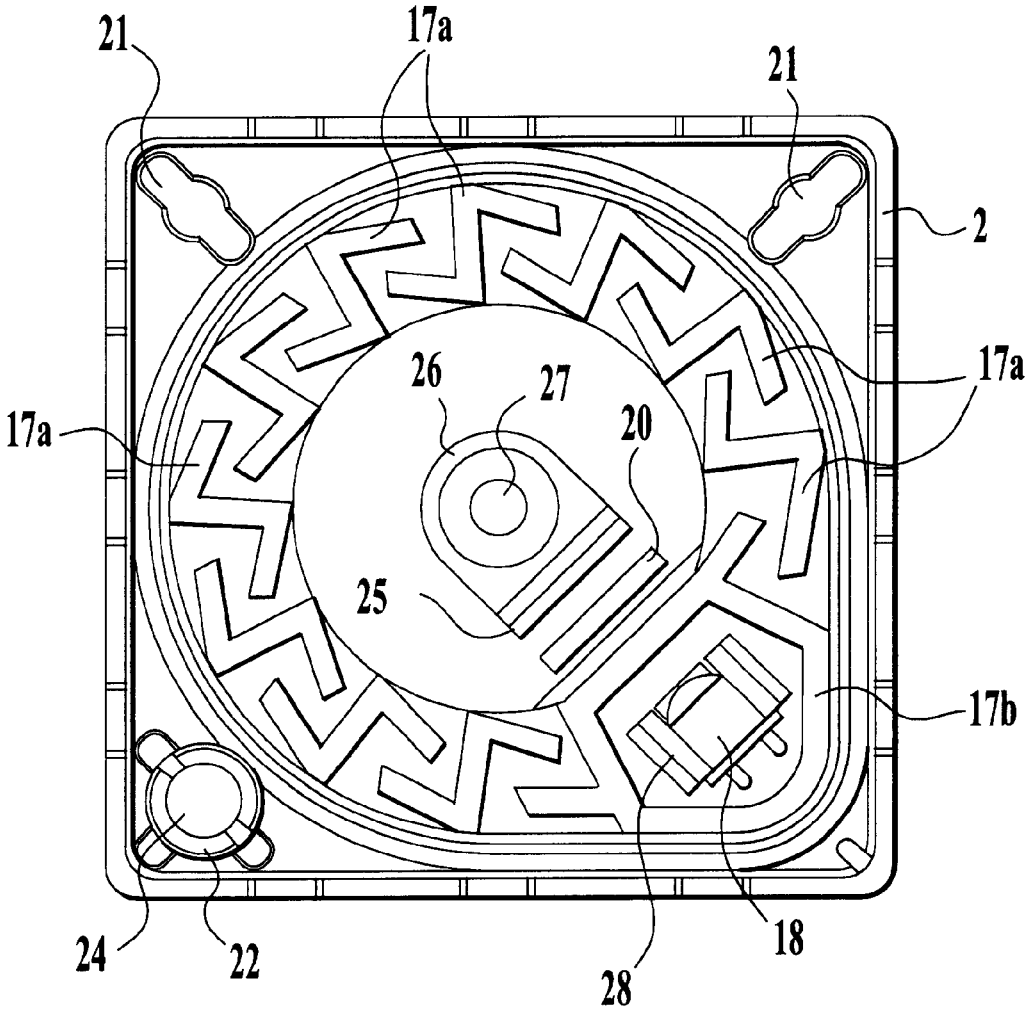
FIG. 4 is a sectional view of the fire detector along a D—D line shown in FIG. 2C.

The labyrinth member 17 is provided so as to erect it in a state that Z members 17*a* having an approximately Z sectional shape and an element backward wall 17*b* surrounding a part except a emitting side of the light emitting element 18 are spaced as shown in FIG. 4. The peripheral portion of the labyrinth member 17 has a form based on an inscribed circle of the approximately square top cover 16. A part thereof is transformed along with a corner of the top cover 16. The labyrinth member 17 has an approximately pear-shaped sectional shape which projects in one direction. The labyrinth member 17 comprises a space in the center thereof.

Figure 5A:
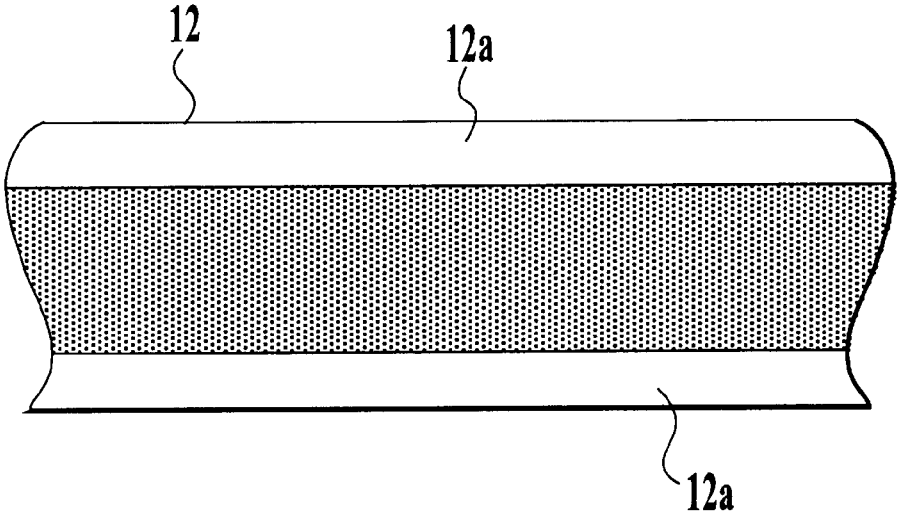

Although the smoke can be entered from the outside, the light cannot be entered into the labyrinth member 17. The labyrinth member 17 is surrounded by the insect screen 12 to prevent an insect from invading. The insect screen 12 comprises a number of fine holes as a net of meshes, which are formed on the metal thin plate by etching. The insect screen 12 according to the embodiment, comprises edge portions having a predetermined width, which are not etched as unprocessed areas 12*a* and 12*a* as shown in FIG. 3 or FIG. 5A. The width of the unprocessed areas 12*a* and 12*a* is wider than that of unprocessed area 100*a*, 100*a* of an insect screen 100 of a fire detector shown in FIG. 5B according to an earlier development.

When the fire detector 1 is viewed in upper and lower directions thereof, a light emitting part 13 comprises the light emitting element 18, props 21 and 21, support member 22 for lens and the like on the approximately square plate 23. The light emitting part 13 is made of black resin mainly. In the embodiment, the smoke chamber comprises the top cover 16, the labyrinth member 17 and the plate 23 as described heretofore.

The light emitting element 18 is a light source used for detecting a smoke, wherein the lead wire 18*a* and 18*a* thereof is connected to the circuit board 50 electrically by passing through a connection hole 51 formed on the circuit board 50. The light emitting element 18 is stored in the element backward wall 17*b* in a state that the light emitting element 18 is supported by an element holder 28 to keep the optical axis horizontal in the smoke chamber.

A stop member 19*b* corresponding to the above-described stop member 19*a* is disposed in front of the light emitting element 18. The first light shielding plate 25 is also disposed in front of the stop member 19*b*. The concrete structure of those stop members 19*a* and 19*b* and the first light shielding plate 25 will be explained hereafter.

Further, a circular light shielding member 26 comprising a detecting hole 27 is disposed at the center of the plate 23. The light detecting element 52 appears through the detecting hole 27 as shown in FIGS. 2A to 2C. As shown in FIG. 3, the circular light shielding member 26 has a circular shape when the circular light shielding member 26 is shown in a plan view. The circular light shielding member 26 has a step 26*a* which is one step lower than the upper end portion of the circular light shielding member 26 in the inner side thereof as shown in FIGS. 2A to 2C. Besides, the circular light shielding member 26 is formed with the first light shielding plate 25 in one body.

The slant 23*e* is formed around the circular light shielding member 26 so as to be higher gradually toward the circular light shielding member 26.

The props 21 and 21 are a plate-shaped ones fixed on the plate 23. The edge portions thereof can be embedded into the holes 16*b* and 16*b*.

Figure 6:
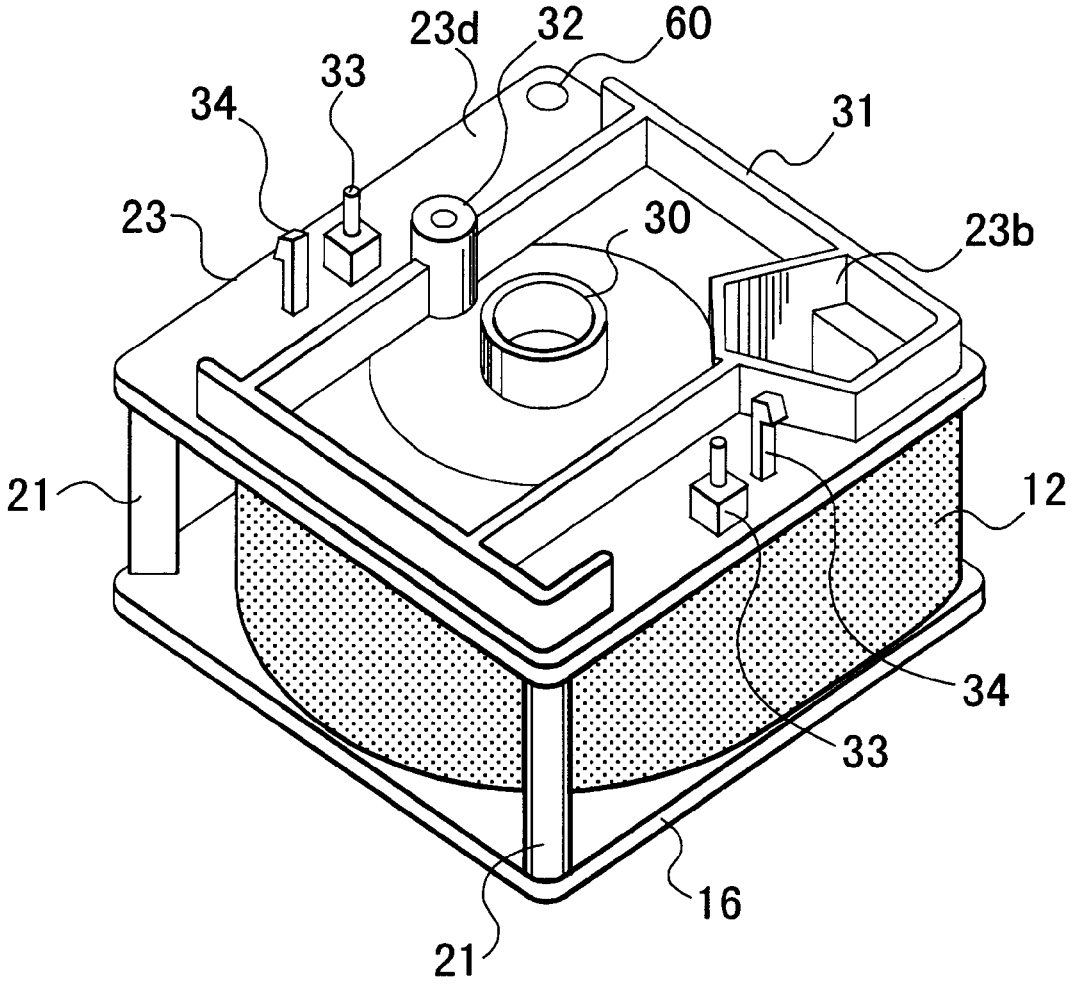
FIG. 6 is a perspective view of a rear side of the plate shown in FIG. 2 and FIG. 3.

The support member 22 for lens is provided so as to erect it on the plate 23 and has an approximately cylindrical shape so as to have a penetrating hole 60 which penetrates the plate 23. A stick-type of lens 24 is stored in the penetrating hole 60 as shown in FIG. 2B. The lower surface of the lens 24 stored in the support member 22 for lens, projects out of the plate 23 and is disposed on the upper position of an LED 53 of the circuit board 50, FIG. 6 shows a rear face 23*d* of the plate 23. In FIG. 6, the reference numeral 23*b* denotes a lead hole through which the lead wires 18*a* and 18*a* pass, the reference numeral 30 denotes a noise light shielding portion and the reference numeral of 31 denotes the noise light shielding wall.

The noise light shielding portion 30 is a cylindrical shaped member connected to the light detecting hole 27. The light detecting element 52 can be stored therein.

The noise light shielding wall 31 is formed so as to surround the noise light shielding portion 30 and has an approximately equivalent height to the noise light shielding portion 30 with reference to the rear face 23*d*.

When the circuit board 50 is put on the rear face 23*d* so that the light detecting element 52 can be stored in the noise light shielding portion 30, the whole upper edge portion of the noise light shielding portion 30 and that of the noise light shielding wall 31 are in contact with the circuit board 50.

Accordingly, the light detecting element 52 is shielded doubly by both of the noise light shielding portion 30 and the noise light shielding wall 31. Further, a cylindrical projection 32 formed in the noise light shielding wall 31 is embedded into a circular hole 50*a* of the circuit board 50 and used for positioning of the circuit board 50 in a side direction.

Hooks 34 and 34 for fixing the circuit board 50 and pins 33 and 33 for positioning the circuit board 50 are formed on the rear face 23*d*.

A detecting part 14 for detecting a fire with the fire detector 1, comprises the circuit board 50 and parts which are mounted thereon.

The light detecting element 52 is surface-mounted at the center of the circuit board 50. The light detecting element 52 detects the light entering from the light detecting hole 27. Because the light detecting element 52 is surface-mounted, the electrical noise inputted into the light detecting element 52 can be reduced.

The LED (light emitting diode) 53 is surface-mounted at one of corners of the circuit board 50. The lower surface of the lens 24 is arranged in the upper position of the LED so as to face to the LED 53. The lens 24 is formed out of a resin. According to the fire detector 1, the LED 53 emits a light during the operation. The emitted light is introduced upward through the lens 24. Because the upper end portion of the lens 24 is embedded into a lens hole 5 of the upper case 2, it is confirmed that the fire detector 1 is operated from the outside thereof by the emitting the upper end portion of the lens 24.

Further, four connection pins 56 which are rigid and straight, are disposed on the rear face of the circuit board 50 so as to project downward. The circuit board 50 is electrically connected to the outside through the four connection pins 56. Only leading edge portions of the each connection pins 56 are shown in FIG. 3.

Most surface area (in which dots are plotted in FIG. 3) of the circuit board 50 on which the light detecting element is mounted, is stained black by a paint or the photoresist reaction.

Pin holes 55 and 55 into which the pins 33 and 33 of the rear face 23*d* of the plate are embedded and the hooking holes 54 and 54 in which the hooks 34 and 34 are embedded, are formed on the circuit board 50.

The smoke entering part 11 and the plate 23 are assembled in one body by fitting the props 21 and 21 to the holes 16*b* and 16*b* of the top cover 16 and fitting the lens 24 to the lens hole 16*c* when the plate 23 and the top cover 16 face to each other. Then, the light emitting element 18 is stored in the element backward wall 17*b*. The stop members 19*a* and 19*b* face to each other in upper and lower directions and thus the stop 19 (see FIG. 7B) is formed. The first light shielding plate 25 and the second light shielding plate 20 are arranged in each predetermined position.

In this state, the rear face 23*d* of the plate 23 is put on the circuit board 50 and then fixed with the projecting portion 32, the pins 33 and 33, and the hooks 34 and 34.

Accordingly, it is possible to construct a structure so that the light emitting element 18, the light detecting element 52, the first light shielding plate 25 and the second light shielding plate 20 and the like are arranged in each predetermined position.

Secondary, the concrete structure of the first light shielding plate 25 and the second light shielding plate 20 and the optical relationship including the light emitting element 18 and light detecting element 52 will be explained.

The light emitting element 18 is disposed on the projecting portion in the smoke entering part 11, so that the optical axis thereof is horizontal in the smoke chamber as shown in FIG. 4. Meanwhile, the light detecting element 52 is mounted on the circuit board 50 and arranged out of the smoke chamber as described in FIG. 2C, so that the optical axis thereof is approximately perpendicular to the optical axis of the light emitting element 18 in the smoke entering part 11.

Regarding a totally miniaturized fire detector, because the reflected light generated by reflecting a light emitted by the light emitting element on the inner side of the smoke chamber is not generally reduced enough, a noise light is increased and therefore the S/N ratio is decreased. In such a structure that the optical axis of the light emitting element and that of the light detecting element are perpendicular to each other along with the vertical direction as described above, various types of noise lights generated in the smoke chamber are shown in FIG. 7A.

Figure 7A:
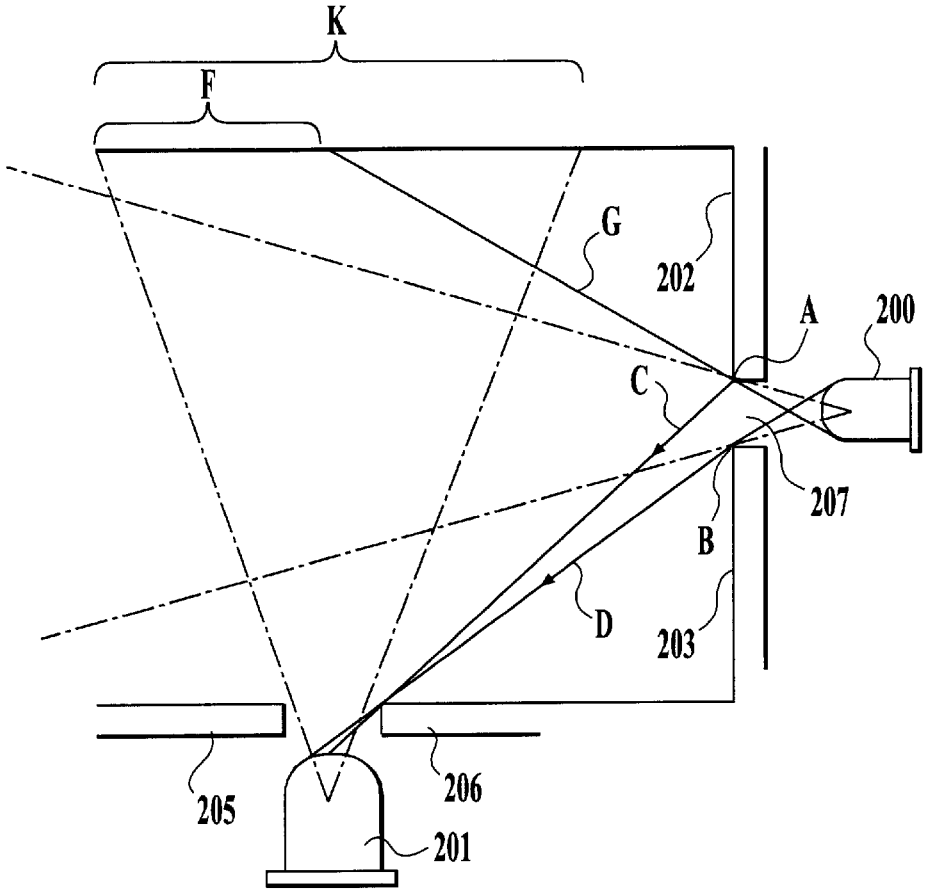

In FIG. 7A, a light emitted by a light emitting element 200 passes through a circular stop 207 formed between stop members 202 and 203, and spreads into the smoke chamber. Although only a relatively strong light (shown as one dotted broken lines) emitted from the center of the light emitting element 200 can be passed by providing the stop 207, it is impossible to prevent perfectly a weak light (for example, G) from leaking out to a circumference. The leaked light reflected on the ceiling of the smoke chamber, which is included in a monitoring area (K) of a light detecting element 201, is detected as a noise. A reflected light (C) from an edge portion A of the stop member 202 and a diffracted light (D) from an edge portion B of the stop member 203 are also detected as a noise.

Figure 7B:
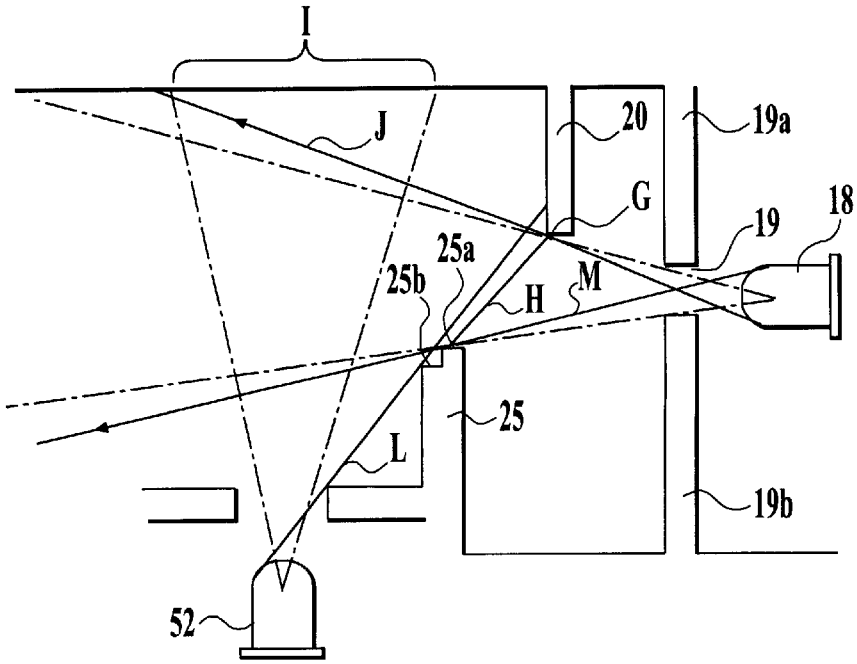

However, in the fire detector 1 according to the invention, the noise is prevented from being generated because of a structure as shown in FIG. 7B. Further, the structure of the circular light shielding part 26 is simplified in FIG. 7B.

According to the fire detector 1, the first light shielding plate 25 having an approximately plate-like shape and the second light shielding plate 20 are disposed respectively in front of the stop 19 between the light emitting element 18 and the smoke detecting area at a predetermined interval so that the axis of the light emitting element 18 is put in them.

The first light shielding plate 25 is arranged on the light detecting element 52 side of the optical axis of the light emitting member 18. In the direction of the optical axis thereof, the first light shielding plate 25 is arranged in the position closer to the light detecting than the second light shielding plate 20. Steps having an upper step 25*a* and a lower step 25*b* are formed on an upper end portion of the first light shielding plate 25 toward the light detecting element.

Hereby, both edge portions of the first light shielding plate 25 and the second light shielding plate 20 are disposed out of a boundary (Line L) of an angle of view of the light detecting element 52. In this case, when viewed from the side of the light detecting element 52, an edge portion G of the second light shielding plate 20 is hidden behind the first light shielding plate 25. The first light shielding plate 25 is formed on the plate 23, and the second light shielding plate 20 is formed on the top cover 16 respectively in one body.

Because of these structures, for example, a range of an irradiation of the above weak light emitted by the light emitting element 18, is determined by virtue of the edge portion G of the second light shielding plate 20. Therefore, the light does not reach a monitoring area I of the light detecting element 52, differently from the fire detector shown in FIG. 7A.

When the weak light emitted by the light emitting element 18, is directed to the light detecting element 52, the weak light is shielded by the first light shielding plate 25. Therefore, the weak light is not detected on the light detecting element 52.

Further, when a light reflected on an edge portion G is directed downward, the light is shielded by the first light shielding plate 25. Therefore, the reflected light is not directed to the light detecting element 52. The light diffracted on the upper step 25*a* of the first light shielding plate 25 is shielded by the lower step 25*b*. Therefore, the diffracted light is not detected by the light detecting element 52.

Namely, because of the structure as shown in FIG. 7B, a light reflected on the ceiling, a light directed from the second light shielding plate 20 toward the light detecting element 52 and a light directed from the first light shielding plate 25 toward the light detecting element 52 are excluded from the detectable range of the light detecting element 52. According to the invention, as described above, regarding a vertical direction of the smoke chamber, which includes both optical axis of the light emitting element 18 and that of the light detecting element 52, the existence of the step 19 is not so important.

The board receiving part 15 is a box for storing the circuit board 50. Four connection holes 15*b*, 15*b*, 15*b* and 15*b* into which the connection pins 56 are inserted, are formed on the board receiving part 15. A projecting portion 15*a* for fixing a base 3 thereto, is formed on the lower surface of the board receiving part 15 (see FIG. 2).

Next, the upper case 2 and the lower case 3 which are composed of the casing, are explained.

The upper case 2 has a box body whose bottom is opened and stores the main body 10 therein. As shown in FIGS. 1A to 1B, the three smoke holes 4, 4, and 4 through which the smoke enters are formed on each upper part of four side surfaces of the upper case 2. The insect screen 12 and the top cover 16 for covering the smoke chamber can be seen through the smoke holes 4, 4 and 4. The lens hole 5 which corresponds to the lens prop 24 is provided on the upper face of the upper case 2.

The spring groove 8 is formed between two convex portions 7 and 7 parallel to each other on the upper surface of the upper case 2 so as to prevent the fixed spring 6 will be described hereafter from being released.

The upper case 2 is fixed to the board receiving part 15 in the upper case 2 by using a screw 9.

The base 3 is a member for supporting the main body 10 through the board receiving part 15. The base 3 comprises a base hole (not shown in the figure) into which a projecting portion 15*a* of the board receiving part 15 can be embedded and a pin engaging part (not shown in the figure) with which the four connection pins 56, 56, 56 and 56 projecting from the connection pin holes 15*b*, 15*b*, 15*b* and 15*b* of the board receiving part 15 can be engaged.

Further, external terminals 3*a* are provided on the side surface of the base 3 to connect to an external circuit.

The fixed spring 6 for fixing the base 3 to the upper case 2, is attached to the base 3. The fixed spring 6 is rotatable around attachment parts 6*a* and 6*a*.

The main body 10 is covered with the upper case 2. The upper case and the board receiving part 15 are fixed by the screw 9. In this state, while the projecting portion 15*a* of the board receiving part 15 is embedded into the base hole of the base 3, the connection pins 56 are engaged with the pin engaging part. Finally, the fixed spring 6 is hooked at the spring groove 8 of the upper case 2. The upper case 2 and the base 3 are fixed to each other together with the main body 10.

By fixing the main body 10 to the base 3 as described heretofore, the connection pins 56 of the circuit board 50 are electrically connected to the external terminals 3*a* of the base 3.

According to the fire detector 1 described above, because the light emitting element 18 is disposed on the portion projecting from the wall part of the smoke chamber, the distance from the light emitting element to the optical axis of the light detecting element can be prepared well in comparison with a case that the light emitting element and the light detecting element are disposed in vertical direction by using the simply circular smoke chamber. Therefore, the smoke detecting area can be widely prepared. After all, in case that the light emitting element and the light detecting element are disposed in the small circular fire detector so that the optical axis of the light emitting element and that of the light detecting element cross each other along with the vertical direction, when a projecting portion on which the light emitting element is disposed, is positioned at a corner of a square which can store a circular structure formed by the fire detector, the smoke detecting area can be widely prepared well without changing its whole size.

The fire detector is small and has a wide smoke detecting area.

When the fire detector according to the present invention is miniaturized, there is a concern about a noise caused by not reducing a reflected light. According to the fire detector 1, the second light shielding plate 20 is disposed in front of the light emitting element 18. Further, in front of the second light shielding plate 20, the first light shielding plate 25 comprising a step on a upper part thereof is disposed. Therefore, a light reflected on the ceiling, a light directed from the second light shielding plate 20 toward the light detecting element and a light diffracted by the first light shielding plate 25 and directed to the light detecting element are excluded from a detectable range of the light detecting element 52. A noise light is not caused. Therefore, even though it is a small fire detector, the S/N ratio is high.

Further, because the first light shielding plate 25 and the second light shielding plate 20 are formed in one body respectively, by fixing the plate and the top cover in the assembly process, the first light shielding plate 25 and the second light shielding plate 20 can be disposed in each desired position. As a result, the assembly process becomes easy.

In the fire detector 1 which comprises the light emitting element out of the smoke chamber according to an earlier development, although a hole for detecting a scattered light by the light detecting light is provided, a noise light enters through the hole. Therefore, the SIN ratio is decreased. When the axis of the light emitting element and that of the light detecting element cross each other, an undetectable area exists near the light detecting element. There is a feasibility of the false alarm because the inflow of the smoke is not detected.

However, according to the fire detector 1, a hole is not formed on the plate 23 in order simply to detect a light. Because the circular light shielding part 26 is arranged so as to surround the light detecting hole 27, the noise light which is a light reflected on a corner of the inside of the labyrinths member and an edge portion thereof or the like, is prevented from entering into the light detecting element 52. Because the step 26*a* is formed on the circular light shielding part 26, a diffracted light generated at the outer edge portion of the outside of the circular light shielding part 26, can be reflected on the step 26*a*, to prevent the light from being directed toward the light detecting element 52. Consequently, the S/N ratio is improved.

By the slant portion 23*e*, the reflected light can be reduced and the smoke entering into the smoke entering part 11 can be introduced to the smoke detecting area above the light detecting element 52 (if the fire detector is disposed on a ceiling, the smoke is introduced below). Therefore, the detecting sensitivity is improved.

According to the fire detector described above, because the light detecting element and the circuit board are disposed out of the smoke chamber, and the lead hole 23*b* is provided in order to connect the lead wire 18*a* of the light emitting element 18 to the circuit board 50, there is some possibility that a light which leaks out from the lead hole 23*b* to the rear face side of the plate becomes the noise light.

However, in the fire detector 1, the noise light shielding portion 30 and the noise light shielding wall 31 are arranged on the rear face 23*d* of the plate. The whole upper edge potion thereof is arranged so as to contact with a surface of the circuit board 50. Therefore, the light detecting element 52 is shielded doubly to prevent the noise light from being detected. From this point, the S/N ratio is improved and the high detecting sensitivity can be achieved. Because the noise light shielding portion 30 and the noise light shielding wall 31 are formed with the plate 23 in one body, the light can be shielded more.

Because the whole upper edge portion of the noise light shielding portion 30 and that of the noise light shielding wall 31 contacts with the surface of the circuit board 50, a position of the circuit board 50 in a height direction with respect to the plate 23 can be determined in the assembly process. The assembly process is carried out easily.

Additionally, because the fire detector 1 is made of black resin and the surface of the circuit board 50 is also black, an adjacent area of the light detecting element 52 is perfectly dark. Therefore, the S/N ratio is improved.

The fire detector has a square form when viewed in upper and lower directions. The labyrinth member 17 of the smoke entering part 11 is formed into the pear-shape as described above. By taking advantage of three corners of the labyrinth member 17, the props 21 and 21 for fixing the plate 23 and the top cover 16 to each other, and the support member 22 for lens are provided at the three corners to assemble the smoke chamber. After all, without preparing a space to fix the plate 23 and the top cover 16, the prop 21 or the like having enough thickness can be formed. The plate 23 and the top cover 16 can be engaged fast enough not to be released easily.

Moreover, the props 21 and 21 and the support member 22 for lens are arranged at the corners and prevent the smoke which enters through the smoke hole 4 from leaking out of another smoke hole 4. Therefore, the smoke enters into the labyrinth member 17 smoothly and a high entering property can be achieved.

In addition, according to the invention, a hole may be formed on the plate and a prop also may be formed on the top cover.

In the fire detector according to an earlier development, in order to improve the S/N ratio, some structural bodies are arranged in the monitoring area of the rear face of the smoke chamber to face the light detecting element. The reduction of the reflected light is contrived. However, because of the structural bodies, a light reflected on the edge portions thereof is increased in accordance with the positional relation between the light emitting element and the light detecting element. Therefore, there is some possibility that the S/N ratio decrease and that a false alarm is caused by the reflected light.

According to the embodiment, because the center part 16*a* of the rear face of the top cover 16 of the smoke entering part 11 is made smooth (the surface thereof may be formed in all of the shapes, for example, plane surface and spherical one), an effect of the reflected light can be reduced. In this point, the S/N ratio is improved.

An LED to which the lead wire connects is often used for an indication lamp of the fire detector according to an earlier development. In such an LED, a space is caused around the LED by covering the lead wire with an insulating tube. An insect or dust enters into the space. As a result, a false alarm is caused.

However, in the fire detector 1 according to the present invention, the stick-type of lens 24 is used and the LED 53 is surface-mounted. Therefore, a process for mounting the LED is simplified and the storing effectiveness is improved. Because the space for arranging the LED is not caused, the reliability of the detector is improved.

Because the lens 24 penetrates through the upper case 2, the top cover 16 and the plate 23 as shown in FIG. 2C, the assembly process thereof and a positioning thereof become easily.

Figure 5B:
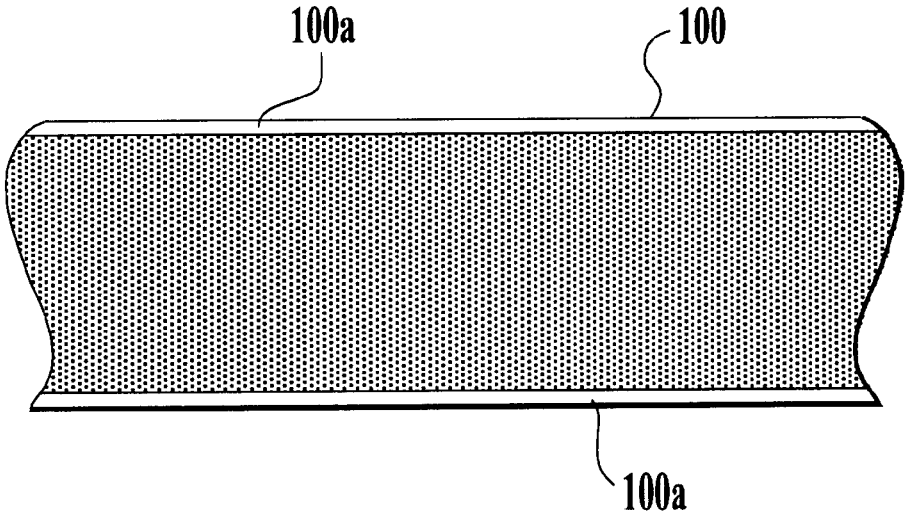

As described heretofore, the labyrinth member 17 according to the embodiment is the approximately pear-shaped, which is a particular shape. When the insect screen according to an earlier development as shown in FIG. 5B is attached to such the labyrinth member having such a shape, the insect screen is distorted and it is difficult to attach it to the labyrinth member because of the weak bending strength.

However, according to the embodiment, because in the insect screen 12, the width of the etching area is narrow and the width of an unprocessed area is wide, the bending strength becomes larger. Therefore, it can be bent easily without the distortion. The insect screen can be easily attached to the labyrinth member 17 having a special shape.

According to the fire detector 1, the fixed spring 6 of the base 3 is fixed by hooking it to the spring groove 8 formed on the upper case 2. According to a fire detector having a cubical shape according to an earlier development, the whole fire detector is fixed by the fixed spring 6.

There is some possibility that the fixed spring is released and that the main body is released from the base because the fire detector does not have the structure for engaging the fixed spring. However, according to the fire detector 1, the fixed spring 6 is not released easily because the fixed spring 6 is engaged with the spring groove 8. Therefore, the upper case 2 and the main body 10 are not released from the base 3.

The present invention is not limited to the above-described embodiment. For example, the labyrinth member may be disposed on the side of the plate.

A shape of the smoke chamber in which the light emitting element is disposed, is not limited to a shape in which a circle has a gentle projection such as the approximately pear-shaped. The smoke chamber may have a shape in which a circle has a rectangular projection or has projections like a frame.

Further, although the step is provided on the first light shielding plate 25 as described above, the step may be provided on the second light shielding plate 20 or on both of them.

When the step is provided at an end portion of the second light shielding plate 20, a light diffracted on the end portion of the second light shielding plate 20 is prevented from reaching the smoke detecting area on the ceiling.

According to the present invention, the light detecting element is disposed at the center of the smoke chamber. That is, because the light detecting element is disposed in the position which is the most distant from an inner wall of the smoke chamber by disposing the light detecting element at the center thereof, the effect of a light reflected on the inner wall can be minimized. The S/N ratio can be increased. Further, because the light emitting element is disposed so that the axis of the light emitting element crosses the axis of the light detecting element, the large smoke detecting area can be prepared. The fire detector having the high S/N ratio is provided.

According to the present invention, because the axis of the light emitting element crosses that of the light detecting element along with the vertical direction, it is possible to miniaturize the fire detector in a horizontal direction. Further, because the light emitting element is arrange in the projecting portion of the smoke chamber, the distance between the axis of the light detecting element and that of the light emitting element can be well prepared, in comparison with an earlier development, for example, in case that the light emitting element and the light detecting element are arranged along the vertical direction by using a circular smoke chamber which is inscribed in the casing. Therefore, the large smoke detecting area can be prepared.

Accordingly, the small fire detector having the large smoke detecting area is provided.

In addition to the effect described above, because the light detecting element is surface-mounted on the circuit board, the assembly process becomes simple. The storing efficiency of the circuit board is also increased.

Because the surrounding member for surrounding the light detecting element, which has a height which is approximately equivalent to the predetermined interval, is arranged between the rear face of the smoke chamber and the circuit board, a noise light, such a light entering into the rear face of the smoke chamber through various holes formed on the smoke chamber according to the necessity of some situations and a light emitted by the light source except the light emitting element disposed on the circuit board, is not detected by the light detecting element. Therefore, the S/N ratio is increased and a high detecting accuracy is achieved.

The surrounding member may be formed on the smoke chamber in one body, a light is shielded more. Therefore, the higher S/N ratio is achieved.

Further, the surface of the circuit board, which faces to the smoke chamber may be black. Therefore, a light reflected on the circuit board or the like is shielded as possible. The S/N ratio is increased.

When an inner surface which faces to the light detecting element of the smoke chamber, is made smooth, an influence caused by a reflection of the light emitted by the light emitting element can be relatively reduced in comparison with a case that an edge portion or the like exists in the inner surface of the smoke chamber. Therefore, the S/N ratio is increased on this point.

Various noise lights which is directed toward the light detecting element, for example, the light reflected on the wall of the inside of the fire detector and the reflected light and the diffracted light or the like emitted by the light shielding plate in the light emitting side can be prevented from reaching the light detecting element by using the two light shielding plates. Therefore, the fire detector having the high S/N ratio is provided.

Even though the diffracted light or the like is generated at the end portion close to the optical axis of the light emitting element, the diffracted light or the like is reflected on the step which is one step lower and which is closer to the light emitting element and can be prevented from reaching the light emitting element. Therefore, the still higher S/N ratio is achieved.

When the two light shielding plates are disposed out of the detectable range of the light detecting element, the smoke detecting area is not small by the two light shielding plates. The reflected light and the diffracted light from the light shielding plates are also prevented from reaching the light detecting element.

Because the two light shielding plates are formed in one body together with the smoke chamber, the two light shielding plates can be arranged at the predetermined position when the smoke chamber is constructed. Therefore, a manufacturing process becomes easy.

Because a light except a scattered light used for sensing a fire, especially a light reflected on the corner and the end portion of the labyrinth member forming on the wall of the smoke chamber, is shielded by the front light shielding member, the S/N ratio can be improved.

Because the diffracted light or the like generated at the edge portion of the front light shielding member is reflected on the step which is one step lower and which is directed toward the light detecting element, and the direction of the reflected light can be changed so as to prevent the reflected light from reaching the light detecting element, the higher S/N ratio is achieved.

Because the smoke entering into the smoke chamber is guided in front of the light detecting element along with the slant which slopes up toward the front light shielding member, the smoke is easily gathered around the detectable range of the light detecting element. Therefore, the detecting sensibility is improved.

When the front light shielding member is formed on the smoke chamber in one body as described above, the assembly process becomes easy.

Because the top cover and the plate are fixed to the support member by using a space which is out of the wall part, the whole smoke chamber is fixed.

Without preparing the space for fixing the plate and the top cover, the support member having an enough thickness can be prepared. The plate and the top cover are fixed strongly so that they are not released easily.

Further, when the support member is disposed on the corner, the support member itself prevents the smoke entering through the smoke hole from floating out through another smoke hole. Because the inflow of the smoke is made smooth, the high inflow property can be achieved.

Because the second light emitting element for the indication lamp may be surface-mounted by using the stick-type of lens, thus a process for surface-mounting a light source for the indication lamp becomes simple. The light source or the like can be arranged more effectively.

Because the lens has the same functions as the support member, the whole smoke chamber is fixed more strongly through the top cover and the plate.

The fixed spring is engaged with the spring groove, the upper case and the lower case are fixed to each other easily and fast.

Because both edge portion sides of the metal thin plate, which have the predetermined width are not etched, the bending strength of the insect screen becomes high. Therefore, the insect screen can be bent into deformed shapes easily and can be applied to any types of fire detectors.

The entire disclosure of Japanese Patent Application No. Tokugan-Hei 11-125383 filed on Apr. 30, 1999 including specification, claims drawings and summary are incorporated herein by reference in its entirety.

What is claimed is:

1. A fire detector for sensing a fire, comprising:

a smoke chamber, a light emitting element, and a light detecting element for detecting a scattered light emitted by the light emitting element when smoke enters the smoke chamber, wherein a wall of the smoke chamber is formed in a shape based on a circle having a predetermined size, and comprises at least a projecting portion which projects from at least a part of the circle to an outside of the circle, the light emitting element being disposed on the projecting portion of the smoke chamber, and the light detecting element being arranged outside the smoke chamber with the optical axis thereof positioned approximately perpendicular to a plane including the whole circle.

2. The fire detector as claimed in claim 1, wherein the optical axis of the light detecting element passes through an approximate center of the circle.

3. The fire detector as claimed in claim 1, wherein the optical axis of the light emitting element is positioned approximately parallel to the plane including the whole circle and is approximately perpendicular to the optical axis of the light detecting element in the smoke chamber.

4. The fire detector as claimed in claim 1, wherein an inner surface of the smoke chamber, which faces to the light detecting element, is made smooth.

5. A fire detector for sensing a fire, comprising;

a smoke chamber, a light emitting element, a light detecting element for detecting a scattered light caused by scattering a light emitted by the light emitting element with a smoke which enters into the smoke chamber, which is provided so that an optical axis of the light detecting element crosses an optical axis of the light emitting element in a predetermined position, and a plurality of light shielding plates for shielding a light, which are disposed between the light emitting element and the smoke detecting area, wherein one light shielding plate selected from the plurality of light shielding plates is arranged so as to prevent the light emitted by the light emitting element from reaching an inner surface of the smoke chamber which is a monitoring area for the light detecting element, and another light shielding plate selected from the plurality of light shielding plates is arranged so as to prevent the light emitted by the light emitting element and then reflected on an end portion of the one light shielding plates from reaching the light detecting element.

6. The fire detector as claimed in claim 5, wherein at least one selected between the one light shielding plate and the another light shielding plate comprises steps so as to be directed toward the light detecting element at an end portion thereof.

7. The fire detector as claimed in claim 5, wherein the two light shielding plates are disposed out of a detectable area of the light detecting element.

8. The fire detector as claimed in claim 5, wherein the optical axis of the light detecting element passes through an approximate center of the smoke chamber.

9. The fire detector as claimed in claim 5, wherein the optical axis of the light emitting element is approximately perpendicular to that of the light detecting element.

10. A fire detector for sensing a fire, comprising:

a light emitting element, a light detecting element for detecting a scattered light emitted by the light emitting element when smoke enters a smoke chamber, the optical axis of the light detecting element crossing the optical axis of the light emitting element, and a front light shielding member for shielding light other than the scattered light and which is disposed in front of the light detecting element;

wherein a wall portion of the smoke chamber is formed in a shape based on a circle having a predetermined size, and wherein the optical axis of the light detecting element is approximately perpendicular to a plane including the whole circle.

11. The fire detector as claimed in claim 10, wherein the optical axis of the light detecting element passes through a approximate center of the smoke chamber.

12. The fire detector as claimed in claim 10, wherein steps which are directed toward the light detecting element are provided on an inner side of the front light shielding member.

13. The fire detector as claimed in claim 10, wherein;

the light detecting element is disposed out of the smoke chamber, a detecting hole is formed on the smoke chamber so that the scattered light can be detected by the light detecting element, the front light shielding member is disposed around the detecting hole in the smoke chamber, and a slant is formed on a peripheral surface of the front light shielding member forming the smoke chamber so as to slope up to the front light shielding member.

14. The fire detector as claimed in claim 10, wherein the optical axis of the light detecting element passes through an approximate center of the circle.

* * * * *